United States Patent [19]

Ourgant

[11] 3,989,241

[45] Nov. 2, 1976

[54] PHYSICAL TRAINING APPARATUS

[76] Inventor: Andre Pierre Joseph Ourgant, 26, avenue de Predecelle, 91470 Limours, France

[22] Filed: June 13, 1975

[21] Appl. No.: 586,705

[30] Foreign Application Priority Data

July 29, 1974 France ..... 74.26315

[52] U.S. Cl. ..... 272/136; 272/142

[51] Int. Cl.[2] ..... A63B 21/00

[58] Field of Search ..... 272/82, 83 R, 67, 79 R, 272/79 C, 79 D, 136, 142

[56] References Cited

UNITED STATES PATENTS

| | | | |
|---|---|---|---|
| 929,281 | 7/1909 | Brodeur | 272/83 R UX |
| 2,252,868 | 8/1941 | Senn | 272/79 D |
| 2,530,921 | 11/1950 | Tougas | 272/79 R |
| 3,345,067 | 10/1967 | Smith | 272/82 |
| 3,430,955 | 3/1969 | Mack | 272/82 X |
| 3,495,824 | 2/1970 | Cuinier | 272/79 C X |
| 3,662,602 | 5/1972 | Weiss | 272/83 R X |

FOREIGN PATENTS OR APPLICATIONS

| | | | |
|---|---|---|---|
| 911,939 | 4/1946 | France | 272/82 |

*Primary Examiner*—Paul E. Shapiro
*Attorney, Agent, or Firm*—Hauke & Patalidis

[57] ABSTRACT

A physical training apparatus comprising a vertical column and two sleeves mounted on the column adjustable in height. One of the sleeves supports a fixed hanger and the other sleeve supports a swing-bar which can rotate through 360° and carries a handle. A brake increases the resistance of the apparatus to the user, said resistance being already adjusted by resilient elements placed between the fixed hanger and the swing-bar.

7 Claims, 5 Drawing Figures

F.
3
III
5
8
30
7
6
1a
1
1b
13
19
11
12
10
14
2
24
1
1c
4
P.

7b
32
9
7a
33
31
30
21

13
15
12
20
23
10
24
22
13
14
16a
18
15
19
16
17
15a
12

5
7
7b
9
α
7a 7
5
7
7b
9
α
7a

PHYSICAL TRAINING APPARATUS

BACKGROUND OF THE INVENTION

The present invention relates to an apparatus provided for physical training which has for its use to enable a plastic development and care of all the muscular groups. This apparatus can also be used for re-education after various traumatisms.

According to the invention, the apparatus comprises a vertical column on which can slide an upper sleeve adjustable in height on the column and supporting on one side thereof a hanger, said hanger having, at each end thereof, at least one fixture connected to first ends of resilient elements having second ends affixed on a swing-bar hinged on an axle mounted on a second sliding sleeve on the column, so as to adjust the height of the swing-bar, the swing-bar being provided, at one end thereof, with handling components, while an adjustable brake tightens at will and without any blocking the hinging axle of the swing-bar.

According to a further feature of the invention, the adjustable brake of the hinging axle supporting the swing-bar is provided with appropriate means for preventing an inopportune loosening of the brake during operation of the physical training apparatus.

Various other features of the invention are moreover shown in the following detailed description.

Embodiments of the present invention are shown by way of examples in the accompanying drawing, in which:

DETAILED DESCRIPTION OF THE PREFERRED EMBODIMENTS

Figures 1, 2, 3, 4, 5:
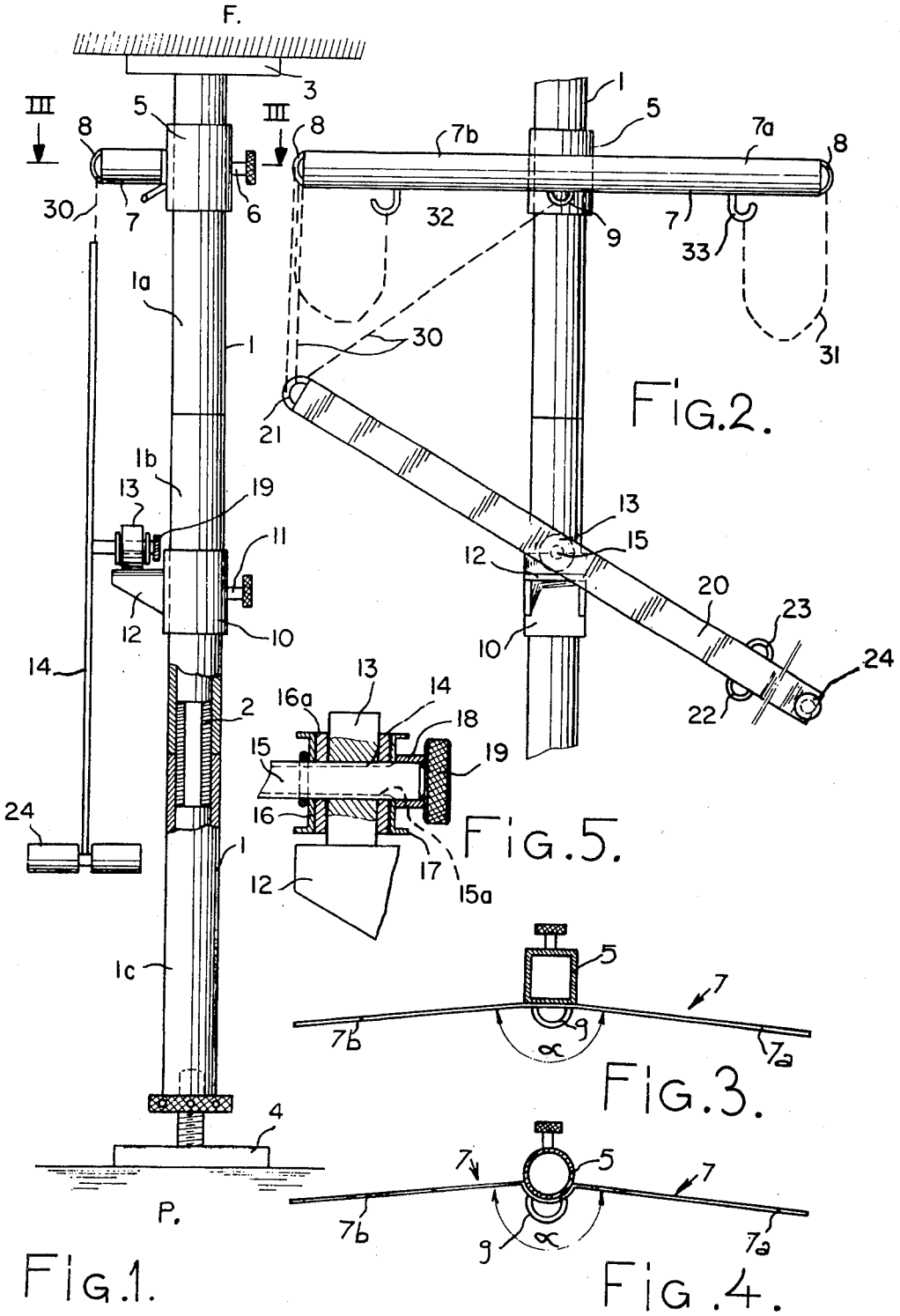
FIG. 1 is a lateral elevation view of an example of a physical training apparatus according to the present invention.
FIG. 2 is a partial front elevation thereof.
FIG. 3 is a sectional view taken along line III—III of FIG. 1.
FIG. 4 is a variant of the embodiment of FIG. 3.
FIG. 5 is an enlarged view of an element of the physical training apparatus of FIGS. 1–3.

In FIG. 1, the physical training apparatus of the invention is shown as composed of a column 1 which in the illustrated embodiment is made of three sections 1*a*, 1*b*, 1*c* to facilitate its transporation. These three sections are connected together end to end by means of inner sleeves 2. The section 1*a* is provided, at its upper end, with a shoulder or plate 3 which bears on the ceiling F of the room in which is placed the physical training apparatus, while the lower end of the section 1*c* comprises a base adjustable through a screw 4 bearing by its lower shoe on the floor P. Thus the column 1 is perfectly held between the ceiling and floor and cannot move; it is only sufficient to check that the column 1 is suitably at right angles to the floor.

A first sleeve 5, slidably mounted on the column 1 can be temporarily fixed on said column at any convenient height by means of a knurled head screw 6. The front side of the sleeve 5 carries a horizontal hanger 7 whose arms 7*a*, 7*b* are angularly shifted to form between each other an angle $\alpha$ smaller than 180° (FIGS. 2 and 3). The hanger 7 is provided, at the ends of its arms 7*a* and 7*b*, with half-rings 8 and, at its central portion, with half-ring 9.

A second sleeve 10, sliding on the column 1, is also temporarily fixed at a convenient height on said column by a knurled head screw 11. The sleeve 10 carries a bracket 12 on an upper portion of which is mounted a vertical stud 13 (see FIGS. 1, 2 and more particularly 5). The vertical stud 13 is provided with a forwardly directed horizontal bore 14 through which is passed an axle or shaft 15 which supports a flanged plate or washer 16 affixed thereupon on the left side of the stud 13, as seen in FIG. 5. The flanged plate 16 is provided with a rubbing packing 16*a* made of frictional material where it engages the surface of the stud 13. At least the right portion of the shaft 15 is provided with grooves 15*a* corresponding to that of the tangs and grooves of a flanged plate or washer 17, this flanged plate 17 being pushed back by a nut 18, having a knurled head 19, threaded on the right end of the shaft 15, thus ensuring an adjustable braking of the rotation of the shaft 15 by rubbing of the two flanged plates 16 and 17 on opposite sides of the vertical stud 13. The flanged plate 17 may also be provided on its side in engagement with the stud 13 with a friction packing, as shown. The shaft 15 supports, at its free end, a swing-bar 20 which can rotate through 360° and has one end provided with a half-ring 21 while, proximate its other end, are affixed two half-rings 22, 23, and at the very end thereof there is pivotally mounted a double handle 24, free to rotate around its pivot, thus causing neither resistance nor stress for the hands of the user.

Lastly, resilient elements 30, such as rubber bands, or coil springs or the like, are placed between the half-rings 8 and/or 9 and the half-ring 21. The apparatus can also be provided with resilient elements 31 between the half-ring 8 of the right portion of the hanger 7 and the half-rings 22 and 23 depending on the position of the swing-bar 20.

Hooks 32, 33, affixed to the hanger 7, provide support means to hang the resilient elements 30, 31 when they are not in use.

In FIGS. 1, 2 and 3, the column 1 is shown as having a square section and the sleeves 5 and 10 have also a square section; but in case the column 1 is of a circular section the sleeves 5 and 10 will have a round section, as shown in FIG. 4.

After placing the column 1 and having adjusted the height of the hanger 7 and of the swing-bar 20 by way of their support sleeves, the resilient elements 30 are placed in a suitable position between the hanger and the swing-bar, and the user does the exercises he has been advised to do. As can be noticed, due to the positional arrangement of the half-rings 8 and 9, the resilient elements 30 may be attached either substantially vertically between the half-rings 21 and 8 or inclined between the half-rings 21 and 9 (see FIG. 2) and, as a consequence of the positioning of the resilient elements, a differential strain can be added to the main strain, the differential strain being then perpendicular to the motion.

The muscular work is perfectly located. The required nerve-impulse is at a minimum, the intensity of the contraction for each exercise goes from 0 to a maximum by an accurate proportion in relation with the strength of each user, thus enabling the use of the apparatus by all members of a family, both by children and by adults.

The half-rings 22, 23 placed on the swing-bar 20 enable to place various resilient elements such as 30 or 31 to increase thereby, and practically without any limit, the working positions, either in relation with the size of the user, or for a desired strain, or also and chiefly for a very localized muscular contraction.

Furthermore, and above all, the brake on the hub of the swing-bar 20 enables to very accurately and immediately determinate the desired opposition during a series of exercises, which is not possible with the musculation apparatus or devices up to now known.

The resilient elements work in an absolutely symmetrical extension, the hanger 7 being, as shown in FIGS. 3 and 4, forwardly shifted relatively to its support, in view of exhibiting the resilient elements in a permanent vertical position, thus coming back to the desired hanging point of the working swing-bar.

The apparatus is absolutely noiseless. The user is free from any physical restraint and can stop the series of contractions at any moment. The rhythmical breathing is at any moment complete and easy since, at the point 0, there is no more resistance.

The invention allows an intense use of the respiratory organs, re-establishing the metabolism of the gaseous exchanges which are reduced with the modern way of life to its vegetative duty. The thoracic development can become important.

Finally, the muscle tonicity, obtained by the very localized contraction, ensures an exceptional support for the spinal column. The very accurately determinated strength for each given exercise spares the nerve impulse compared to that of training with heavy dumbbells.

The invention is not restricted to the embodiments shown and described in detail, for various modifications thereof can moreover be applied thereto without departing from the scope of this invention as shown in the appended claims.

I claim:

1. A physical training apparatus comprising a vertical column, an upper sleeve slidably supported by said column such as to be adjustable in height, a lower sleeve slidably supported by said column so as to be adjustable in height, a hanger fixedly supported by said upper sleeve, a swing-bar mounted on said lower sleeve for swinging about a horizontal pivot axis, said swing-bar being provided at an end thereof with handling components, means on said hanger and said swing-bar for attaching resilient elements therebetween, and adjustable braking means for adjustably setting the resistance to pivoting of said swing-bar about its pivot axis.

2. The apparatus of claim 1 wherein said pivot axis of said swing-bar comprises a stud member supported by said lower sleeve, a shaft passed through said stud member and affixed to said swing-bar, grooves formed longitudinally on said shaft, a grooved friction plate engaged over said shaft such as to be rotatable thereby, and a nut threadably and adjustably engaged on the end of said shaft for adjusting the pressure with which said friction plate engages the surface of said stud member for causing said stud member, said plate and said nut to rotate in unison thus preventing said nut from loosening during operation of said apparatus.

3. The apparatus of claim 1 wherein said means for attaching said resilient elements are disposed at least at one end of said hanger and at one end of said swing-bar.

4. The apparatus of claim 1 wherein said means for attaching said resilient elements are disposed at least at one end of said hanger and substantially at the center of said hanger, and at one end of said swing-bar.

5. The aparatus of claim 4 wherein means for attaching said resilient elements are also disposed proximate the end of said swing-bar provided with said handling components.

6. The apparatus of claim 1 wherein said column is in several sections fastenable to each other in an end to end relationship.

7. The apparatus of claim 1 wherein said column is provided at both ends thereof with bearing plate elements engageable respectively with the ceiling and the floor of a room, said column being adjustable in length to accommodate difference in ceiling height and for applying holding pressure to said ceiling and floor.

* * * * *